United States Patent [19]

Asai

[11] Patent Number: 5,025,580

[45] Date of Patent: Jun. 25, 1991

[54] THREE-DIMENSIONAL CARDS

[75] Inventor: Haruo Asai, Minoo, Japan

[73] Assignee: Shobundo Insatsu Kabushiki Kaisha, Osaka, Japan

[21] Appl. No.: 444,910

[22] Filed: Dec. 4, 1989

[30] Foreign Application Priority Data

Mar. 29, 1989 [JP] Japan ..... 1-36982[U]

[51] Int. Cl.[5] ..... G09F 1/12

[52] U.S. Cl. ..... 40/152.1; 40/158.1; 40/160

[58] Field of Search ..... 40/152.1, 158.1, 617, 40/160, 661; 229/68 C, 71, 92.8; 220/94 R

[56] References Cited

U.S. PATENT DOCUMENTS

| | | | |
|---|---|---|---|
| 1,308,695 | 7/1919 | Bushkovski | 40/152.1 |
| 1,454,953 | 5/1923 | Bunker et al. | 229/68 C X |
| 1,599,779 | 9/1926 | Michlinski et al. | 40/160 |
| 2,236,681 | 4/1941 | Goldschmidt | 229/68 C |
| 3,553,062 | 1/1971 | Berlin | 40/160 X |
| 3,886,677 | 6/1975 | Behring et al. | 40/158.1 |
| 3,986,283 | 10/1976 | Pelaez | 40/158.1 |
| 4,356,647 | 11/1982 | Farris | 40/156 X |
| 4,438,579 | 3/1984 | Engel | 40/661 X |

*Primary Examiner*—Kenneth J. Dorner
*Assistant Examiner*—J. Bonifanti
*Attorney, Agent, or Firm*—Armstrong, Nikaido, Marmelstein, Kubovcik, & Murray

[57] ABSTRACT

This invention discloses a three-dimensional card comprising a card body having a design such as a pattern, figure and/or colored motif on one side and a literal message or a writing space to be filled out on the other side and a frame made of a board which is thicker than the card body and having a central opening, the frame being integrally joined to one side of the card body to render the design visible through the opening. The design may be raised or three-dimensional for added display effect.

14 Claims, 1 Drawing Sheet

THREE-DIMENSIONAL CARDS

BACKGROUND OF THE INVENTION

The present invention relates to a three-dimensional card for use as a sales promotion aid, a souvenir, a greeting card or the like such as a Christmas card, a birthday card or the like.

As cards conveying various messages or information, such as Christmas cards and birthday cards, generally cards available on the market are utilized as they are or home-made cards incorporating various innovations in pattern and design have been employed.

However, such cards, once the information has been read, are usually destined for waste baskets. Even if the pattern and message of such a card are intriguingly attractive or tickle the recipient's interest and the recipient wants to enjoy them by keeping the card at hand, the card which is comparatively thin tends to be bent or broken or be lost in due course.

SUMMARY OF THE INVENTION

It is an object of the present invention to provide a three-dimensional card which is pleasing to the eye and can be kept close at hand and preserved for long without deformation and breakage.

It is another object of the present invention to provide a three-dimensional card which can be set up on the desk or the wall for appreciating its design in a broader perspective.

The above and further objects, features and advantages of the invention will more fully appear from the following description with reference to the accompanying drawings. It is to be expressly understood, however, that the drawings are for purpose of illustration only and are not intended as a definition of the limits of the invention.

DETAILED DESCRIPTION OF THE PREFERRED EMBODIMENTS

Figure 1:
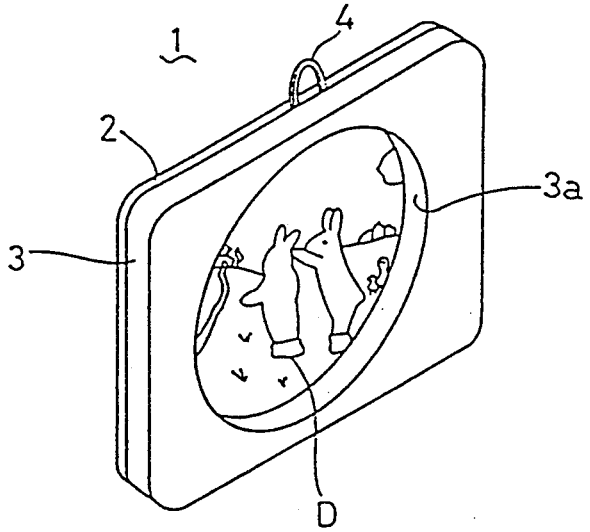
FIG. 1 is a perspective view showing a three-dimensional card according to the invention.
Figure 3:
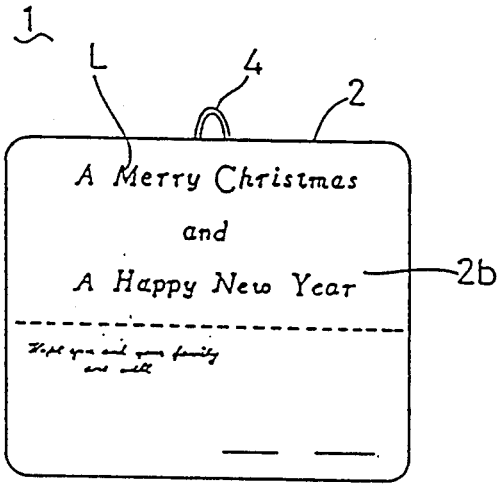
FIG. 3 is a rear view of the three-dimensional card according to the invention.
Figure 2:
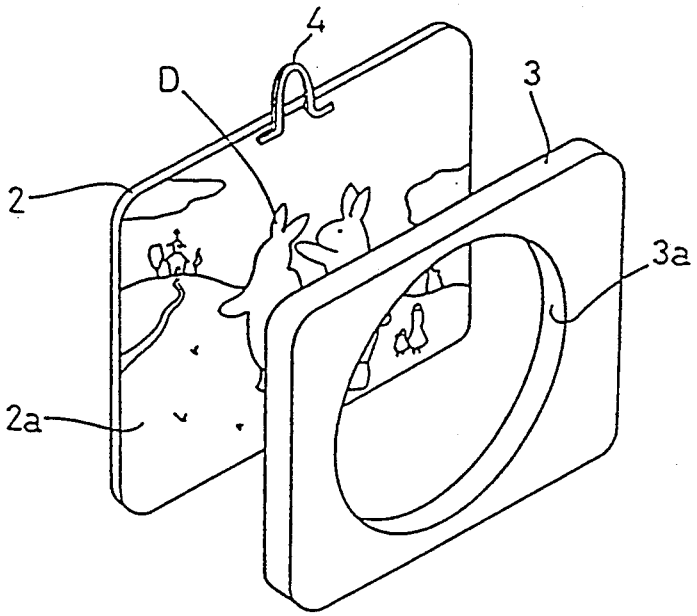
FIG. 2 is a disassembled perspective view showing the three-dimensional card of the invention.

Referring to FIGS. 1 through 3, the three-dimensional card 1 for use as a Christmas card, for instance, comprises a card body 2 and a frame 3.

The card body 2 is made of paper board, synthetic resin plate or wood board and has a design D, such as a figurative pattern, on its face side 2*a* and a literal message L, which may be English letters representing commemorating words for the Christmas and New Year days for instance, or a writing space that can be filled out on its reverse side 2*b*.

The design D may be two-dimensional but is preferably a three-dimensional artifact made out of paper board or textile cloth or a combination of two dimensional and three-dimensional artifacts. In the embodiment illustrated in FIG. 1, the background and the rabbit at left are two-dimensional, while the rabbit at right is made of paper board or fabric and is three-dimensional. This kind of design provides a perspective representation and more pleasing to the eye than the mere two-dimensional design. It should be understood that when a three-dimensional representation is chosen for design D, its thickness should not be greater than the depth of the frame 3.

The above-mentioned design D need not necessarily be a mere black-and-white design but may be a colored pattern or figure or a literal message, such as mentioned above, which may be rendered in any language inclusive of the English language. Furthermore, the design D and the literal message L may be directly printed on the card body 2 or printed on a sheet or the like which is to be glued to the card body 2.

The frame 3 is a board or plate which is thicker, for example at least 2-fold, than the card body 2 and is firmly affixed to the card body 2, for example with an adhesive, to provide an integral unit. The frame 3 may also be made of paper board, synthetic resin plate or wood board. The frame 3 is provided with a circular opening or window 3*a* which is large enough to insure that the above-mentioned design D may be clearly viewed through it. It should, of course, be understood that this opening 3*a* need not be circular but may for example be vertically oblong, horizontally oblong or rectangular.

The above card body 2 and frame 3 have corners rounded to present a neat contour and can be suspended by means of a hanging cord 4 attached to the card body.

The beauty of the design D on the surface of the card body 2 is thus accentuated by the deep opening 3*a* of the frame 3 and the card 1 as a whole has a sufficient structural rigidity because of the integral assemblage of the card body 2 and frame 3.

The three-dimensional card 1 thus constructed can be simply accommodated in an envelope and mailed.

The three-dimensional card 1 according to the present invention need not be a Christmas card or a birthday card but may be a card of seasonal greetings or commemoration or as a business sales promotion aid or souvenir. Moreover, this card can be suspended from a Christmas tree using the attached cord 4.

While there has been described what is at present considered to be preferred embodiments of the invention, it will be understood that various modifications may be made herein, and it is intended to cover in the appended claims all such modifications as fall within the scope of the invention.

What is claimed is:

1. A card comprising:

a card body bearing a design on one side thereof, and a configured member attached to said one side of said card body, said configured member being configured in a motif pattern associated with said design, and said card body having another side bearing indicia;

a frame composed of a plate having a thickness which is at least twice that of said card body and having a window-like opening in a central region of said frame, said window-like opening being larger than said design;

a hanging cord having a loop portion and two ends extending outwardly from said loop portion, said hanging cord being arranged in a generally Ω-shaped configuration; and said frame having a first surface and a second surface which is opposite said first surface, said first surface being integrally bonded to said one side of said card body with said two ends of said hanging cord being sandwiched between said frame and said card body such that said loop portion of said hanging cord projects beyond said frame, and said configured member being recessed with respect to said second surface of said frame.

2. A card as claimed in claim 1, wherein said frame is composed of paper board.

3. A card as claimed in claim 1, wherein said frame is composed of synthetic resin board.

4. A card as claimed in claim 1, wherein said frame is composed of wood.

5. A card as claimed in claim 1, wherein said configured member is composed of paper board.

6. A card as claimed in claim 1, wherein said configured member is composed of cloth.

7. A card as claimed in claim 1, wherein said another side of said card body bears indicia representing a message.

8. A card comprising:

a relatively thin card body bearing a design on one side thereof, and a configured member attached to said one side of said card body, said configured member being configured in a three-dimensional motif pattern associated with said design, and said card body having another side bearing indicia;

a frame composed of a plate having a thickness which is at least twice that of said card body and having a window-like opening larger than said design in a central region of said frame; and a hanging cord having two ends extending outwardly from a loop portion, said hanging cord being arranged in a generally Ω-shaped configuration;

said frame having a first surface and a second surface which is opposite said first surface, said first surface being integrally bonded to said one side of said card body with said two ends of said hanging cord sandwiched between said frame and said card body such that said loop portion of said hanging cord projects beyond said frame, and said configured member being recessed with respect to said second surface of said frame so as to protect said configured member.

9. A card as claimed in claim 8, wherein said frame is composed of paper board.

10. A card as claimed in claim 8, wherein said frame is composed of synthetic resin board.

11. A card as claimed in claim 8, wherein said frame is composed of wood.

12. A card as claimed in claim 8, wherein said configured member is composed of paper board.

13. A card as claimed in claim 8, wherein said configured member is composed of cloth.

14. A card as claimed in claim 8, wherein said another side of said card body bears indicia representing a message.

* * * * *